United States Patent [19]

Ohashi et al.

[11] 4,335,200

[45] Jun. 15, 1982

[54] SILVER HALIDE PHOTOGRAPHIC MATERIALS

[75] Inventors: Minoru Ohashi; Katsuaki Iwaosa, both of Nagaokakyo, Japan

[73] Assignee: Mitsubishi Paper Mills, Ltd., Tokyo, Japan

[21] Appl. No.: 297,419

[22] Filed: Aug. 28, 1981

[30] Foreign Application Priority Data

Oct. 30, 1980 [JP] Japan ..... 55/152772

[51] Int. Cl.[3] ..... G03C 1/34

[52] U.S. Cl. ..... 430/446; 430/611

[58] Field of Search ..... 430/448, 445, 446, 611, 430/489, 551

[56] References Cited

U.S. PATENT DOCUMENTS 3,068,099 12/1962 Klinger ..... 430/611

3,888,677 6/1975 Abele et al. ..... 430/611

*Primary Examiner*—Won H. Louie, Jr.

*Attorney, Agent, or Firm*—Cushman, Darby & Cushman

[57] ABSTRACT

A silver halide photosensitive material is stabilized against overdevelopment fogging by containing at least one antifoggant thioether represented by the following general formula I in silver halide emulsion layer and/or layer contiguous to said emulsion layer;

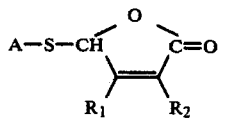

(I)

wherein A represents the heterocyclic group of a mercapto antifoggant; $R_1$ and $R_2$, which may jointly form a benzene ring, represent each a halogen atom or an alkyl, aryl or aryloxy group.

4 Claims, No Drawings

SILVER HALIDE PHOTOGRAPHIC MATERIALS

BACKGROUND OF THE INVENTION

This invention relates to a photosensitive material containing a silver halide emulsion layer stabilized against overdevelopment fogging.

When a silver halide photosensitive material is treated for a very short period of time under severe developing conditions, such as development at a relatively high temperature or development with a highly active developer (a developer at a high temperature and a high pH), there arises a danger of the reduction of silver halide grains containing no latent image nucleus at all. The fog produced under such conditions by the undesirable reduction of undeveloped silver halide grains strongly appears especially at the end of a normal development process and is called overdevelopment fog. The antifoggants known to be effective against the overdevelopment fog include mercury compounds and heterocyclic mercapto compounds. These antifoggants reduce the fogging in a normal developing treatment or in overdevelopment. They have, however, a disadvantage of appreciably reducing the sensitivity of a silver halide photosensitive material when added in an amount sufficient for the reduction of such fogging.

The fundamental disadvantage of adding directly to the silver halide emulsion a heterocyclic mercapto compound particularly active in itself against the overdevelopment fogging lies in that such a compound is perfectly active from the time of addition, namely, it is already in active form throughout the storage period of the photographic material and in the development stage. As a consequence, it exerts an undesirable desensitizing effect during the manufacturing and storage of a photographic material. In order to avoid such a difficulty, an attempt was already made to substitute the mercapto group of the antifoggant compound by a suitable hydrolyzable group so that it may become possible to inactivate the antifogging activity during the period (including the manufacturing period and succeeding period before the development stage) in which such an activity is not desired and then in the development stage regenerate the active form by alkaline hydrolysis. Such substituted compounds are thioesters and thioethers of the mercapto antifoggants. The thioesters are those of carboxylic acids, sulfonic acids and carbonate derivatives disclosed in many patents such as, for example, German Pat. No. 1,597,503, U.S. Pat. No. 3,260,597 and German Patent Application "Offenlegungsschrift" No. 2,061,972. The thioesters, however, have a disadvantage in that although being hydrolyzable in alkaline developer media, they also gradually undergo partial hydrolysis in neutral or weakly acidic pH range. Therefore, although the thioester-type antifoggants can be added in inactive form as such to an emulsion, they exert an undesirable desensitizing effect due to partial hydrolysis when quite an extended time is required in the manufacture of emulsion or storage of the photographic material. In contrast to the thioesters, the antifoggants having a substituent of the thioether type, such as those disclosed, for example, in U.S. Pat. Nos. 2,981,624 and 3,260,597 and German Pat. No. 1,173,796, are quite stable in neutral or weakly acidic media, but are unable to prevent effectively the overdevelopment fogging, because they do not regenerate or regenerate very slowly the original mercapto antifoggants in the development process.

SUMMARY OF THE INVENTION

An object of this invention, therefore, is to provide an antifoggant having an inactivated mercapto group which is stable in the neutral or weakly acidic pH region, but is capable of liberating an active antifoggant to a required degree in the alkaline pH region, i.e. in developing treatment (hereinafter such an antifoggant is referred to as antifoggant precursor).

DESCRIPTION OF THE INVENTION

The present inventors investigated various compounds for the above purpose and, as a result, found that the thioethers represented by the following general formula (I) meet the requirements:

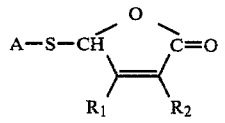

(I)

wherein A represents a heterocyclic group of the mercapto antifoggant and each $R_1$ and $R_2$ represent a halogen atom, an alkyl group having preferably 1 to 5 carbon atoms, an aryl group, or an aryloxy group; said aryl or aryloxy group may be substituted by an alkyl group, a halogen atom or a carboxyl group; and $R_1$ and $R_2$ may jointly form a benzene ring which may be substituted by an alkyl group, a halogen atom, an alkoxy group or nitro group. The said mercapto antifoggant may be any which has an antifogging activity, but is most preferably a 5- or 6-membered heterocyclic compound having nitrogen as hetero atom. Typical examples of such hetero rings include tetrazole, 1,2,4-triazole, benzoxazole, benzothiazole, pyridine and pyrimidine rings.

Examples of the typical antifoggant precursors of this invention which correspond to the general formula (I) are given below, but the examples are not to be construed as limitative.

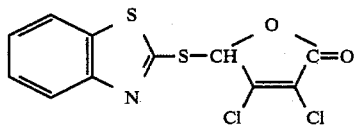

Compound No. 1

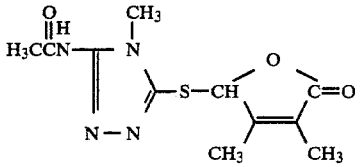

Compound No. 3

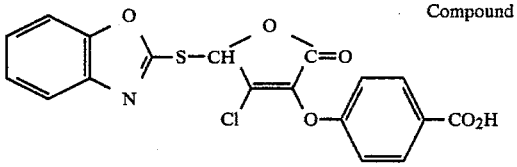

-continued

Compound No. 4

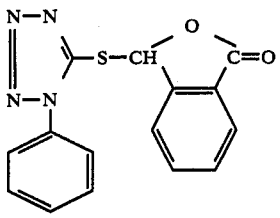

Compound No. 5

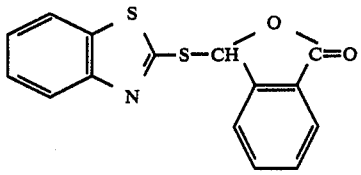

Compound No. 6

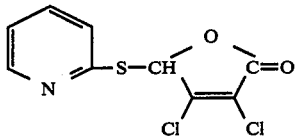

Compound No. 7

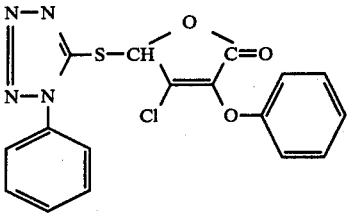

Compound No. 8

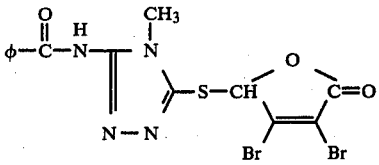

Compound No. 9

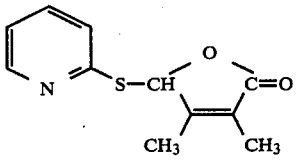

Compound No. 10

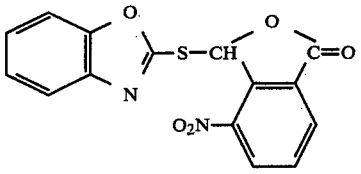

Compound No. 11

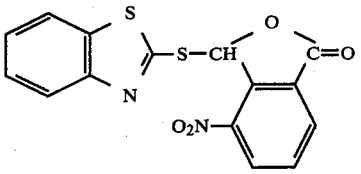

-continued

Compound No. 12

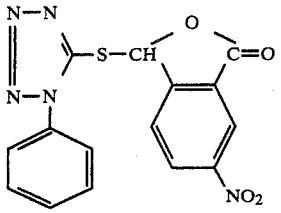

As will be apparent from Synthesis Example given below, the compound of this invention represented by the general formula (I) is easily prepared by the action of an alkalin substance such as, for example, triethylamine on a mixture of a mercapto antifoggant and a halogenated compound represented by the following general formula (II):

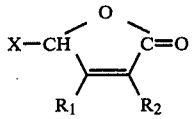

(II)

wherein $R_1$ and $R_2$ are as defined above and X represents a halogen atom.

An example of the synthesis of an antifoggant precursor of this invention is given below.

SYNTHESIS EXAMPLE (SYNTHESIS OF COMPOUND NO. 4)

Into 150 ml of dioxane, were dissolved 16.9 g of 3-chlorophthalide and 17.9 g of 1-phenyl-5-mercaptotetrazole. To the solution, while being cooled in water and stirred, was added portionwise 14 ml of triethylamine. After completion of the addition, the mixture was heated in an oil bath at about 110° C. for about one hour. The precipitated triethylamine hydrochloride was removed by filtration and the filtrate was freed from the solvent by distillation in vacuo to precipitate crude crystals which were recrystallized from ethyl acetate to obtain Compound No. 4; yield, 28.6 g; melting point, 153.5°-154° C.

| Elementary analysis: | C% | H% | N% |
|---|---|---|---|
| Calculated | 58.05 | 3.25 | 18.06 |
| Found | 58.00 | 3.31 | 18.01 |

The antifoggant precursor according to this invention can be incorporated in silver halide emulsion layers of the photographic material or in other colloid layers which are permeable to water through to or out from said emulsion layers, such as, for example, an overcoat or undercoat for the emulsion layers. The present precursor can be incorporated in the silver halide emulsions or the colloidal dispersions by dissolving the precursor in suitable solvents such as, for example, DMF, methanol and ethanol, adding the solution to the silver halide emulsion or the colloidal dispersion prior to coating. Alternatively, by using the technique disclosed in Japanese Patent Pre-exampled Publication (Kokai) No. 137,131/78, the present precursor can be dispersed in a latex and added to the silver halide emulsion or the colloidal dispersion. In incorporating the present precursor in the silver halide emulsion, it can be added in any stage during the manufacture of the emulsion, but it is preferable to add just before coating of the emulsion.

The suitable concentration of the present antifoggant precursor varies depending on the type of compound and the location to be applied of the precursor within the photosensitive material. When added to the silver halide emulsion layer, the amount of the precursor for one mole of silver halide is generally 0.1 to 100, preferably 0.5 to 50 mmoles. It is used in somewhat larger concentrations when added to other colloid layers which are in contact with silver halide emulsion layers or which will become in contact with the latter layers in development treatment.

After exposure, the photosensitive materials containing the present antifoggant precursor in a silver halide emulsion layer and/or in other colloid layers which are permeable to water through to or out from the emulsion layer is developed with customary developers. The developed photosensitive material of this invention can be stabilized in a customary fixing bath or stabilizing bath.

The silver halide emulsion suitable for the present photosensitive material can be of any type such as, for example, a spectrally sensitized or nonsensitized emulsion, X-ray emulsion, or infrared sensitive emulsion. It may also be a high sensitivity negative emulsion or a low sensitivity positive emulsion and may be of the orthochromatic or panchromatic type. The photosensitive silver salts suitable for the present photosensitive material include various silver salts such as, for example, silver bromide, silver iodide, silver chloride, and mixed silver halides (silver chlorobromide, silver iodobromide, etc.). These silver halides can be dispersed in common hydrophilic colloids such as, for example, gelatin, casein, polyvinyl alcohol, and carboxymethylcellulose. Of these colloids, gelatin is advantageous. The silver halide emulsion can be chemically or optically sensitized. Chemical sensitization is carried out by ripening the emulsion in the presence of a small amount of a sulfur compound such as, for example, allyl thiocyanate, allylthiourea, or sodium thiosulfate. Further, the emulsion can be sensitized with a reducing agent such as a tin compound (e.g. French Pat. No. 1,146,955 and U.S. Pat. No. 2,487,850) or an imino-aminomethanesulfinic acid compound (e.g. British Pat. No. 789,823) and a small amount of a noble metal such as, for example, gold, platinum, palladium, iridium, ruthenium, or rhodium. Also, it can be optically sensitized with cyanine dyes and merocyanine dyes.

Other additives such as, for example, development accelerators, sensitizing agents and antioxidants can be added to the silver halide emulsion layer or other water-permeable colloid layers. The present antifoggant precursor can be used in combination with other antifoggants or other antifoggant precursors.

The invention is illustrated below in detail with reference to Examples.

EXAMPLES

A silver iodochlorobromide emulsion (65.5 mole-% silver bromide, 34.0 mole-% silver chloride, 0.5 mole-% silver iodide) of 0.45 μm in average particle size was prepared by the neutral single jet process. After physical ripening and salt removal by washing with water, the emulsion was mixed with gelatin followed by sodium thiosulfate. After the chemical sensitization, the emulsion was finished by adding a stabilizer, surface active agent and hardener.

The gelatin-silver halide emulsion thus prepared was divided into 10 portions. To each of the 5 portions, was added one of the antifoggant precursor compounds described above as examples, in an amount of 2 mmoles per mole of silver halide. For comparison, to each of the two remaining portions, was added 1-phenyl-5-mercapto-tetrazole or 2-mercaptobenzothiazole in an amount of 2 mmoles per mole of silver halide (comparative samples A). To another 2 portions, were added respectively two thioethers of the following formula, in an amount of 2 mmoles per mole of silver halide (comparative samples B).

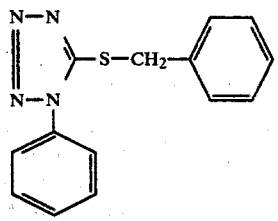

(Comparative sample B-1)

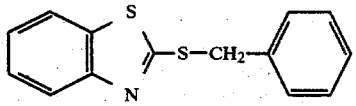

(Comparative sample B-2)

No antifoggant was added to the remaining portion (comparative sample C).

The 10 emulsions obtained were each coated on a photographic base sheet coated on both sides with polyethylene and dried, the coverage having been 2.5 g/m$^2$ in terms of silver nitrate and 6.0 g/m$^2$ in terms of gelatin. Each of the 10 test specimens thus prepared was cut into 2 portions. The one was heated at 40° C. for 5 days and the other was heated at 50° C. and 80% relative humidity for 5 days.

A portion of each specimen was exposed through an optical step wedge and developed at 20° C. for 120 seconds with a developer of the following composition:

| Developer: | |
|---|---|
| Water | 750 ml |
| Metol | 1.0 g |
| Hydroquinone | 4.0 g |
| Sodium sulfite | 15.0 g |
| Sodium carbonate (monohydrate) | 26.7 g |
| Potassium bromide | 0.7 g |
| Water to make up to | 1,000 ml |

After stopping, fixing, water washing, and drying, each specimen was tested for photographic characteristics. The unexposed portion of each specimen was developed with the same developer at 20° C. for 10 minutes to examine the fog level. The results obtained were as shown in Table 1.

TABLE 1

| | Antifoggant precursor compound No. | 40° C., 5 days | | | | 50° C., 80% RH, 5 days | | | |
|---|---|---|---|---|---|---|---|---|---|
| | | Sensitivity ratio | γ | Max. density | Fog | Sensitivity ratio | γ | Max. density | Fog |
| Sample No. | | | | | | | | | |
| 1 | 4 | 133.0 | 3.1 | 2.20 | 0.05 | 129.5 | 3.0 | 2.15 | 0.04 |
| 2 | 7 | 130.0 | 3.2 | 2.30 | 0.04 | 129.0 | 3.1 | " | " |
| 3 | 12 | 125.3 | 2.96 | 2.25 | 0.05 | 126.0 | 2.9 | 2.20 | " |
| 4 | 1 | 130.6 | 3.2 | 2.30 | 0.04 | 130.0 | 3.1 | " | 0.05 |
| 5 | 5 | 132.0 | 3.3 | 2.21 | " | 129.5 | 3.0 | 2.18 | 0.03 |
| Comparative Sample No. | | | | | | | | | |
| A-1 | 1-Phenyl-5-mercapto-tetrazole | 100.0 | 2.8 | 2.10 | 0.04 | 95.0 | 27.3 | 2.00 | 0.03 |
| A-2 | 2-Mercaptobenzothiazole | 98.0 | 2.69 | 2.0 | 0.03 | 93.3 | 2.63 | " | " |
| B-1 | Comparative Compound B-1 | 133.0 | 3.1 | 2.31 | 0.24 | 135.3 | 2.98 | 2.20 | 0.23 |
| B-2 | Comparative Compound B-2 | 130.5 | 2.9 | 2.26 | 0.23 | 132.5 | 2.83 | 2.18 | 0.20 |
| C | None | 135.0 | 3.0 | 2.30 | 0.25 | 138.3 | 2.90 | 2.20 | 0.27 |

As is apparent from the results shown in Table 1, the compound of this invention causes little decrease in maximum density and little flattening of gradient (i.e. little decrease in gamma value), indicating no adverse effect on photographic characteristics. Since the difference in heating conditions resulted in no great change in photographic characteristics, it is apparent that the partial hydrolysis of the present antifoggant precursor did not take place during storage of the photosensitive material. Further, from the observed fact that the fog levels of the samples of this invention are far lower than those of the comparative samples B and C and approximate that of comparative sample A, it is apparent that the antifoggant precursor of this invention hydrolyzed effectively in the developer to release the corresponding antifoggant. Moreover, as is apparent from the data of sensitivity ratio (the sensitivity of comparative sample A-1 after having been heated at 40° C. for 5 days was assumed to be 100), the anti-foggant precursor of this invention does not cause such undesirable decline of sensitivity as is observed in the cases of comparative samples A-1 and A-2.

What is claimed is:

1. A silver halide photosensitive material characterized in that at least one silver halide emulsion layer and/or a layer contiguous to said emulsion layer contains at least one antifoggant of the general formula (I)

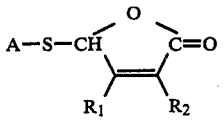

wherein A represents the heterocyclic group of a mercapto antifoggant; $R_1$ and $R_2$, which may jointly form a benzene ring, represent each a halogen atom or an alkyl, aryl or aryloxy group.

2. A silver halide photosensitive material according to claim 1 wherein the heterocyclic group A in the general formula I is selected from tetrazole, 1,2,4-triazole, benzoxazole, benzothiazole, pyridine and pyrimidine.

3. A silver halide photosensitive material according to claim 1 wherein the antiffogant is selected from the group consisting of

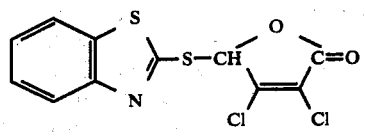

Compound No. 1

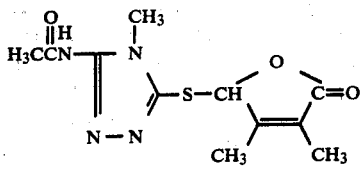

Compound No. 2

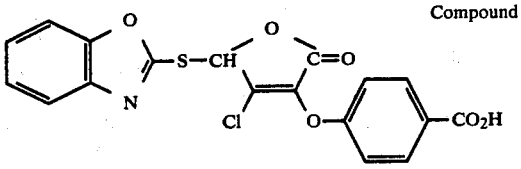

Compound No. 3

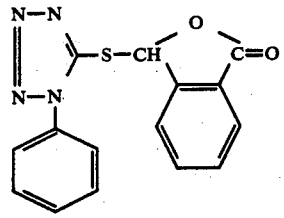

Compound No. 4

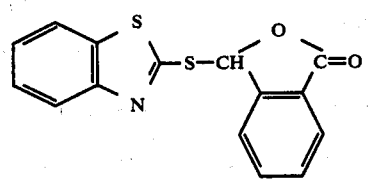

Compound No. 5

-continued

Compound No. 6

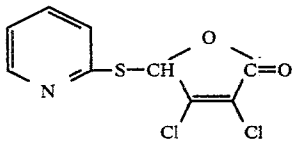

Compound No. 7

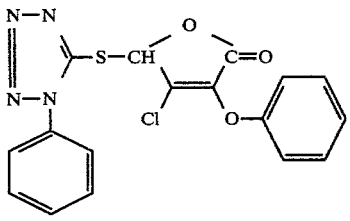

Compound No. 8

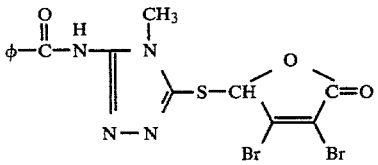

Compound No. 9

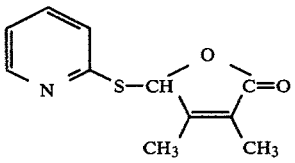

-continued

Compound No. 10

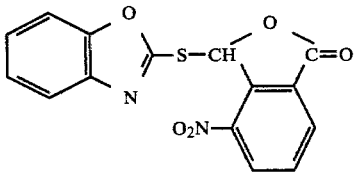

Compound No. 11

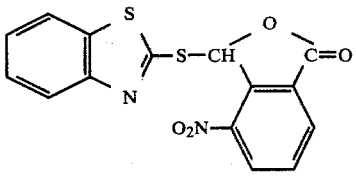

Compound No. 12

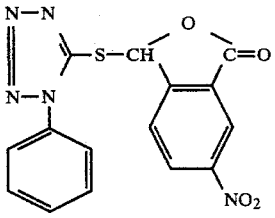

4. A process for preparing an image which comprises imagewise exposing a silver halide emulsion layer of a silver halide photosensitive material and developing it in the presence of at least one antifoggant of the general formula (I) which is contained in the silver halide emulsion layer and/or a layer contiguous thereto

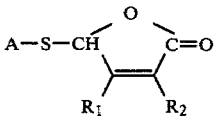

(I)

wherein A represents the heterocyclic group of a mercapto antifoggant; $R_1$ and $R_2$, which may jointly form a benzene ring, represent each a halogen atom or an alkyl, aryl or aryloxy group.

* * * * *